United States Patent [19]

Maurer

[11] Patent Number: 4,717,025

[45] Date of Patent: Jan. 5, 1988

[54] SHIPPING PACKAGE ADAPTED FOR MECHANICAL HANDLING AND STACKING

[75] Inventor: Donald J. Maurer, Cedar Rapids, Iowa

[73] Assignee: Raytheon Company, Lexington, Mass.

[21] Appl. No.: 948,383

[22] Filed: Dec. 31, 1986

[51] Int. Cl.[4] ..... B65D 19/04

[52] U.S. Cl. ..... 206/599; 53/396; 108/51.3; 108/55.3; 206/586; 229/166; 493/162

[58] Field of Search ..... 108/51.3, 53.1, 55.1, 108/55.3, 56.1; 206/320, 386, 523, 586, 595–600; 229/166, 172, 173, 178, 180; 493/160, 162; 53/396

[56] References Cited

U.S. PATENT DOCUMENTS

| | | | |
|---|---|---|---|
| 1,585,684 | 5/1926 | Oppenheim . | |
| 2,753,101 | 7/1956 | Zimmerman . | |
| 3,136,473 | 6/1964 | Kieffer | 229/166 |
| 3,202,335 | 8/1965 | Budd . | |
| 3,246,824 | 4/1966 | Gardner | 108/51.3 |
| 3,356,209 | 12/1967 | Pezely, Jr. . | |
| 3,442,436 | 5/1969 | Kirby, Jr. . | |
| 3,451,534 | 6/1969 | De Remer et al. . | |
| 3,493,107 | 2/1970 | Markey . | |
| 3,495,756 | 2/1970 | Achermann et al. . | |
| 3,519,190 | 7/1970 | Achermann et al. | 206/599 |
| 3,608,813 | 9/1971 | Blasdell | 206/599 |
| 3,701,465 | 10/1972 | Richter . | |
| 3,828,965 | 8/1974 | Yarbrough . | |
| 4,042,107 | 8/1977 | Kendig . | |
| 4,113,096 | 9/1978 | Scott . | |
| 4,133,430 | 1/1979 | Cravens . | |
| 4,372,221 | 2/1983 | White | 108/51.3 |
| 4,378,743 | 4/1983 | McFarland . | |
| 4,610,355 | 9/1986 | Maurer | 206/386 |

FOREIGN PATENT DOCUMENTS

| | | | |
|---|---|---|---|
| 1589366 | 5/1981 | United Kingdom | 229/172 |

*Primary Examiner*—Jimmy G. Foster

*Attorney, Agent, or Firm*—William R. Clark; Richard Sharkansky

[57] ABSTRACT

A structurally self supporting shipping package adapted for use with mechanical handling equipment. The package may be embodied as a base or as a unitary carton formed by bending a single sheet of material such as fiberboard. The package includes a horizontal panel elevated by adjacent upward facing rectangular channels. Flaps formed at the ends of the channels engage rails formed along the sides of the panel, to transfer shear stress away from the channels and towards the rails. The rails may be assisted by flaps formed adjacent their connection to the panel. The package may be further strengthened if certain portions are formed by placing multiple thicknesses of material adjacent each other. The structurally self-supporting package allows accommodation of a variety of oddly shaped items. Package assembly may be expedited if the rails are formed in sections.

9 Claims, 12 Drawing Figures

SHIPPING PACKAGE ADAPTED FOR MECHANICAL HANDLING AND STACKING

BACKGROUND OF THE INVENTION

This invention relates generally to shipping containers and more particularly to shipping bases, caps, and cartons adapted for handling and stacking by mechanical container handling equipment.

As is well known, an item may be encapsulated for protection against shock and vibration occurring during shipment and handling. It has been conventional to suspend the item in a carton with encapsulating material disposed along top and bottom edges of the item. The encapsulating material serves to both protect the item from vibration as well as to keep foreign objects that may penetrate the carton from contacting the item. As such cartons are often stacked upon each other in a warehouse, the carton and encapsulating material should have sufficient load bearing capability to support multiple items.

One way to solve the problem of adapting such a carton for use with mechanical handling equipment is described in my U.S. Pat. No. 4,610,355 for "Shipping Base Having an Entry Slot for Mechanical Material Handling Equipment", issued Sept. 9, 1986 and assigned to Amana Refrigeration, Inc. That carton includes a shipping base adapted to elevate the bottom of the item in order to provide an entry slot for mechanical handling equipment. The shipping base is formed of cardboard or similar material folded to form a horizontal panel and upward facing rectangular channels disposed along and integrally connected to opposing edges of the horizonal panel. Polystyrene shipping pads are inserted in the channels for physically supporting as well as encapsulating the item. If desired, the item and shipping base may be covered by shrink film or a conventional shipping sleeve open at one end.

While this shipping base works well for most applications, in other applications certain problems have occurred. In particular, if multiple heavy items packaged in the base are arranged in a stack, the stack may tend to lean as time passes. This occurs particularly if the rectangular channels and polystyrene shipping pads are less than adequate for supporting the weight of multiple items in the stack. It may also occur if the various components of the base spread apart, causing it to become dimensionally unstable. Such spreading apart may occur when weight is applied to the base or the base is placed on an uneven surface. Additionally, if the cardboard sleeve is used with stacked items, it may tend to slip or telescope from one item down over an item placed lower in the stack. It then becomes difficult to insert the mechanical handler into the entry slot. When straps are used to hold the sleeve and shipping base together, a flap portion of the sleeve adjacent the fork entry may tend to obstruct the fork entry if the straps loosen. This is a problem particularly when the mechanical handling equipment must be operated amongst package designed with minimal fork entry clearances. It has also been found to be difficult to adapt this shipping base to items having other than a rectangular shape. The cardboard sleeve tends to buckle and/or bow if it is desired to use certain types of squeeze-clamp mechancial handling equipment. Other problems occur in the assembly of the shipping base such as the requirement for a special assembly jig and a tendency for the associated shipping pads to shift or fall out during the packaging process.

SUMMARY OF THE INVENTION

Accordingly, it is an object of the invention to provide a structurally self-supporting shipping base for use with mechanical handling equipment such as forklifts and squeeze clamps.

Another object is to provide a shipping package that will not buckle or telescope when arranged in stacks.

A further object is to provide a shipping package adapted to accommodate half-slotted containers in a stacked configuration.

Yet another object is to obviate the problem of sleeve flaps blocking the fork entry.

An additional object is to accommodate the packaging of items having shapes other than rectangular.

Still another object is to expedite the shipping package assembly process by eliminating the need for a special jig and to keep associated shipping pads from shifting during assembly.

Briefly, these and other objects are accomplished by a shipping package having an entry slot adapted for insertion of mechanical handling equipment, the shipping package including a horizontal panel integrally connected to upward facing rectangular channels along opposing edges of the horizontal panel. A pair of stiffened rails are formed along the remaining sides of the horizontal panel perpendicular to the rectangular channels. Flaps formed on outer edges of the rectangular channel fold to engage the rails and transfer the weight of the packaged item away from the rectangular channels and towards the rails. The weight of the packaged item may also be dispersed to the horizontal panel by another flap formed where the rail contacts the horizontal panel.

The rail portion may be composed from multiple thicknesses of material such as that created by folding at least two portions of package material around a structural support member.

Additionally, if a shipping sleeve is used, it is sized so that its greatest outside dimension is smaller than the corresponding inside dimensions of the shipping base, so that when the shipping packages are stacked upon one another, the cardboard sleeve does not telescope over a lower item.

The structural integrity of the shipping base is further improved by forming certain portions of the rectangular channels and/or fork entry portion from multiple thicknesses of material.

As the structural supporting function of the shipping pads may be transferred to the shipping base itself, the shipping pads may be split and/or arranged in various shapes to encapsulate the item only. This removes previous restrictions on their formation and provides the ability to accomomodate a variety of item shapes.

The problem of loose flaps blocking the fork entry is obviated by either eliminating the flaps altogether or making the flaps quite large in order to keep them from coming loose.

If a positioning tab is formed in the rail portion of the shipping base, it assists in retaining the shipping pads during package assembly.

Package assembly may be further expedited by forming the rail portion in multiple sections including at least a main section and two end retaining sections, where the end retaining sections are folded to temporarily hold the sides of the shipping base perpendicular to the rails and horizontal panel.

BRIEF DESCRIPTION OF THE DRAWINGS

The foregoing and other objects, advantages and novel features of this invention become apparent from the following detailed description when considered with the accompanying drawings, wherein.

DETAILED DESCRIPTION OF THE PREFERRED EMBODIMENTS

Figure 1:
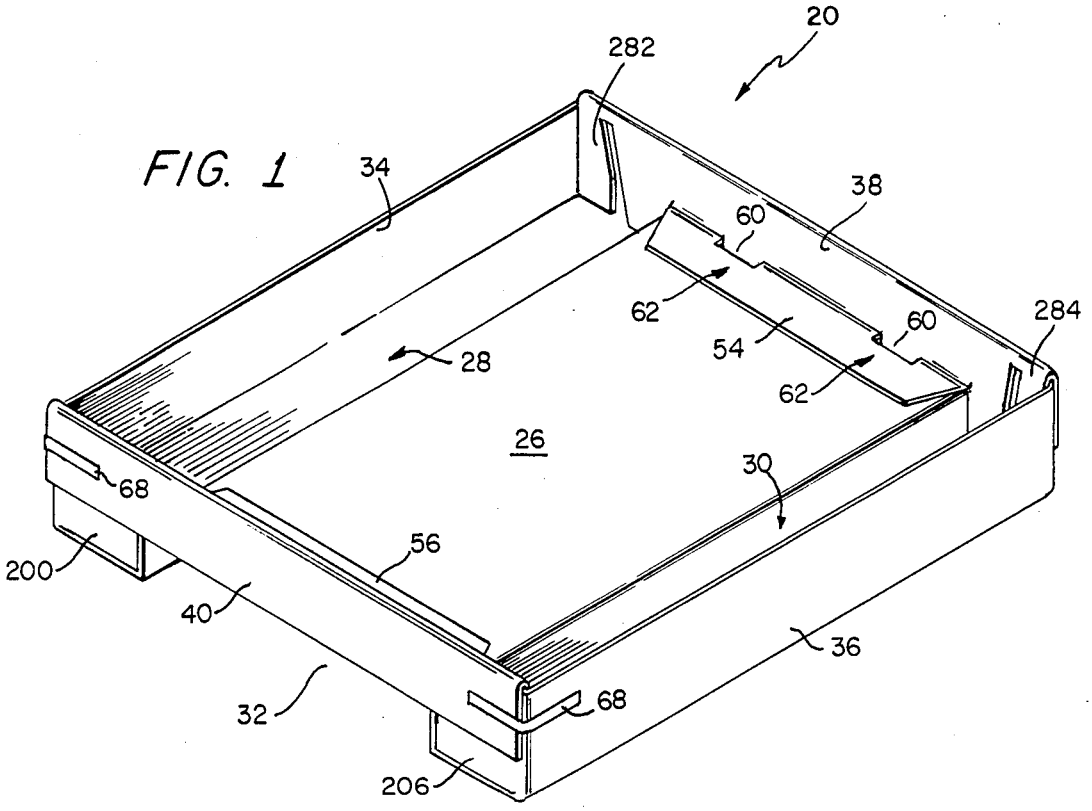
FIG. 1 is a perspective view of a shipping base according to the invention.

Referring now to the drawings, where like reference characters designate corresponding parts throughout the several figures, there is shown in FIG. 1 a shipping base 20 according to this invention, including horizontal panel 26 and left and right upward facing rectangular channels 28 and 30 formed adjacent and integrally connected to horizontal panel 26. Channels 28 and 30 serve to elevate panel 26 thereby providing an entry slot 32 in the space below panel 26 and between channels 28 and 30. Entry slot 32 is suitably sized for entry by mechanical handling equipment such as the protruding forks of a conventional forklift. The outer walls of channels 28 and 30 define vertical side panels 34 and 36 respectively of shipping base 20. Shipping base 20 also has rear and front vertical rail portions 38 and 40 formed adjacent opposing edges of horizontal panel 26 and perpendicular to vertical side panels 34 and 36. Side panel flaps 200 and 206 are formed adjacent opposing ends of side panels 34 and 36 respectively. A vertical rail 40 is adapted to engage side panel flap 200 adjacent side panel 34 as well as to engage side panel flap 206 adjacent side panel 36. Two similar side panel flaps (not shown in FIG. 1) are formed adjacent the other opposing ends of side panels 34 and 36 near rear vertical rail 38. Rear vertical rail 38 is also adapted to accept the two similar side panel flaps. Rail flaps 54 and 56 are formed adjacent respective vertical rails 38 and 40 and are adapted to engage horizontal panel 26 by, for example, inserting rail flap tabs 60 into horizontal panel slots 62. Rail flap tabs 60 are formed adjacent rail flaps 54 and 56 while horizontal panel slots 62 are formed in horizontal panel 26. Pad retaining tabs 282 and 284 may be formed in the portions of vertical rails 38 and 40 adjacent vertical side panels 34 and 36. Fasteners 68 such as tape or staples serve to assist in keeping vertical side panels 34 and 36 engaged with front and rear vertical rails 40 and 38.

It is thus seen from FIG. 1 that shipping base 20 solves several problems of the prior art. In particular, side panel flaps 200 and 206 serve to transfer sheer stress from side panels 34 and 36 to front vertical rail 40. Front rail flap 56 serves to transfer stress from front vertical rail 40 to horizontal panel 26. Similar load shifting occurs at the rear of shipping base 20 by other side panel flaps also formed adjacent side panels 34 and 36 and arranged to engage rear vertical rail 38. A rear rail flap 54 also engages horizontal panel 26. Thus, greater structural integrity has been provided to shipping base 20 by distributing stress caused at rectangular channels 28 and 30 to other portions of shipping base 20.

Figure 2:
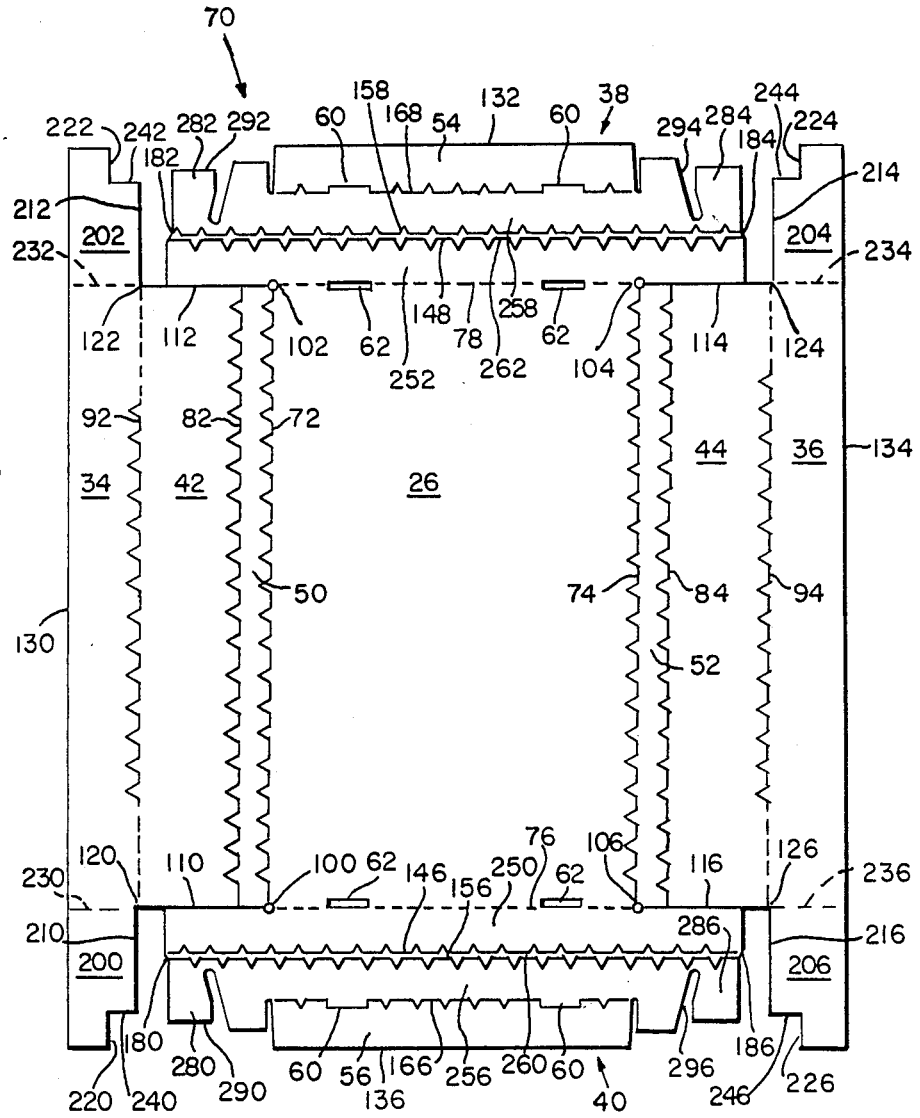
FIG. 2 is a plan view of a single blank of material from which the shipping base of FIG. 1 may be formed.

As illustrated in FIG. 2, shipping base 20 is preferably formed from a unitary rectangular sheet 70 of foldable material such as corrugated fiberboard or cardboard. Horizontal panel 26 is formed in the interior portion of sheet 70 by opposing longitudinal score lines 72 and 74 as well as opposing transverse score lines 76 and 78. Score lines such as 72, 74, 76 and 78 may be perforated, crushed or a combination thereof. The preferred score line form depends on the application for shipping base 20, and involves trading off of ease of assembly with structural strength. It can also be seen from FIG. 2 that longitudinal score lines 82 and 92, disposed between score line 72 and longitudinal edge 130 of sheet 70, serve to partially define left vertical side panel 34, left foot panel 42 and left interior panel 50. Similar longitudinal score lines 84 and 94 disposed between score line 74 and opposing longitudinal edge 134 define right vertical side panel 36, right foot panel 44 and right interior side panel 52.

Longitudinal score line 72 extends between punch holes 100 and 102. Slits 110 and 112 extend away from and perpendicular to the ends of score lines 72, 82 and 92 towards points 120 and 122 adjacent side panel 34. Longitudinal score line 72 extends between punch holes 104 and 106. Slits 114 and 116 also extend from punch holes 104 and 106 towards points 124 and 126 adjacent side panel 36. Slits 110, 112, 114 and 116 serve to further define the several foot and interior panels 42, 44, 50 and 52 formed in sheet 70. Punch holes 100, 102, 104 and 106 prevent slits 110, 112, 114 and 116 from tearing sheet 70.

Figure 3:
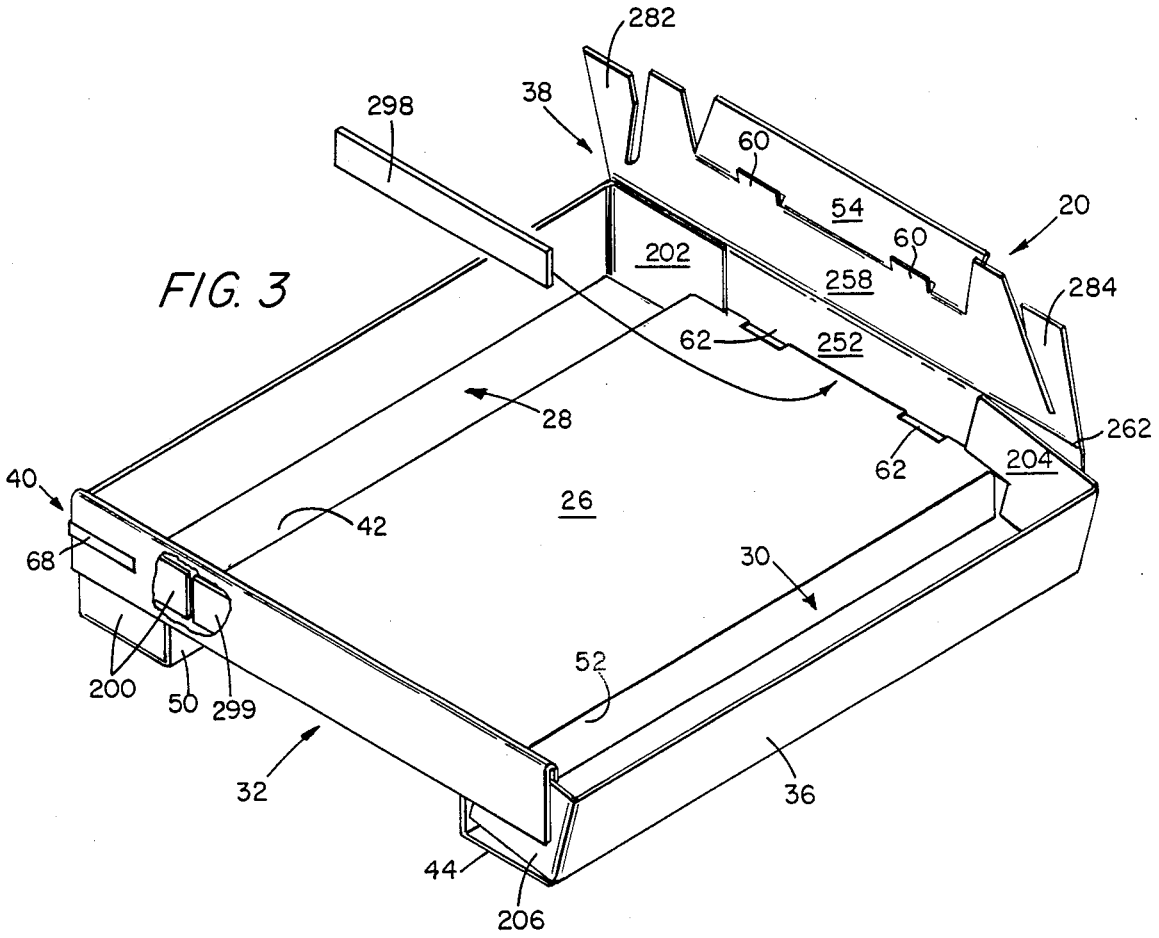
FIG. 3 is a perspective view of a partially assembled shipping base.

FIG. 3 is a perspective view of shipping base 20 in the process of being assembled. By considering FIG. 2 and FIG. 3 together, it can be seen that upward facing rectangular channel 28 is defined by vertical side panel 34, foot panel 42 and interior side panel 50 just as upward facing rectangular channel 30 is formed by vertical side panel 36, foot panel 44 and interior side panel 52. More particularly, rectangular channel 28 is formed by a downward vertical bend in sheet 70 along score line 72 placing interior panel 50 perpendicular to horizontal panel 26, an outward horizontal bend along score line 82 positioning foot panel 42 substantially perpendicular to interior side panel 50 and in a plane substantially parallel to and beneath horizontal panel 26, and an upward vertical bend along score line 92 to position vertical side panel 34 substantially perpendicular to foot panel 42 and in parallel with interior panel 50. Rectangular channel 30 is similarly formed by a downward vertical bend in sheet 70 along score line 74, an outward horizontal bend along score line 84 and an upward vertical bend along score line 94, to position interior panel 52, foot panel 44 and vertical side panel 36. The resulting space between channels 28 and 30 forms the entry slot 32.

Returning attention briefly to FIG. 2, it can be seen that side panel flaps 200 and 202 are formed by score lines 230 and 232 adjacent opposing ends of side panel 34. As will be seen shortly, flaps 200 and 202 serve to attach side panel 34 to rails 38 and 40, as well as to transfer sheer stress away from foot panel 42 and side panel 34 towards rails 38 and 40. An inner longitudinal edge 210 and 212 of flaps 200 and 202 is formed to be the same dimension as the transverse dimension of foot panel 42. Inner edges 210 and 212 are formed perpendicular to score lines 230 and 232 and preferably align with score line 92. An inner transverse edge 240 and 242 of flaps 200 and 202 is formed perpendicular to inner longitudinal edges 210 and 212 opposite points 120 and 122. Transverse edges 240 and 242 are not as long as the transverse dimension of flap 200 along score line 230, but rather only as long as the transverse dimension of interior side panel 50. When sheet 70 is assembled to form shipping base 20, inner longitudinal edge 210 of flap 200 engages foot panel 42 and transverse edge 240 engages interior side panel 50. Flap 202 similarly contacts foot and side panels 42 and 50 along longitudinal edge 212 and transverse edge 242.

Flaps 204 and 206 are similarly formed adjacent vertical side panel 36 by score lines 234 and 236. Flaps 204 and 206 have inner longitudinal edges 214 and 216 as well as transverse edges 244 and 246 adapted to engage foot panel 44 and interior side panel 52.

The components of rear and front vertical rails 38 and 40 can be seen as well in FIG. 2. In particular, transverse score lines 146, 156 and 166 are formed in sheet 70 parallel to and betwen transverse score line 76 and a transverse rear edge 136. Transverse score lines 146 and 156 extend between longitudinal edges 180 and 186 adjacent but not touching inner edges 210 and 216 of flaps 200 and 206 respectively.

A front outer rail panel 250 is defined by score lines 76 and 146. Front rail ridge panel 260 is similarly defined by score lines 146 and 156. Score lines 156 and 166 serve to define front inner rail panel 256. In similar fashion, transverse score lines 148, 158 and 168 define rear outer rail panel 252, rear rail ridge panel 262 and rear inner rail panel 258 extending between longitudinal edges 182 and 184. Transverse score line 166 and transverse front edge 136 define rail flap 56 adjacent inner rail panel 256.

A plurality of rail flap tabs 60 are formed in inner rail panel 256 of front rail 40 by forming slits protruding from line 166. A corresponding plurality of panel slots 62 are formed in horizontal panel 26 adjacent score line 76 longitudinally aligned with rail flap tabs 60. Similarly, rear vertical rail 38 has rail flap tabs 60. Panel slots 62 are also formed adjacent score line 78.

Score lines 166 and 168 are shorter than score lines 146 and 156. These form rail flaps 56 and 54 having a transverse dimension equal to or less than the transverse dimension of horizontal panel 26.

It is also evident from FIG. 2 that positioning tabs 280 and 286 are formed as part of rail panel 256 by appropriately shaping its transverse edges 290 and 296. Positioning tabs 280 and 286 are thus formed in a portion of inner rail panel 256 adjacent longitudinal edges 180 and 186. Positioning tabs 282 and 284 are likewise formed in a portion of inner rail panel 258 by appropriately shaping its transverse edges 292 and 294.

Returning attention to FIG. 3, the assembly of rear and front vertical rail 38 and 40 can be better understood. As shown for rear vertical rail 38, after having formed upward facing rectangular channels 28 and 30 as previously described, an inward vertical bend along score line 232 serves to position flap 202 such that its inner longitudinal edge 212 becomes adjacent left foot panel 42 and its transverse edge 242 is adjacent left interior side panel 50. Similarly, an inward vertical bend along score line 234 positions flap 204 adjacent right foot panel 44 and right interior side panel 52. An upward horizontal bend along score line 78 positions outer rail panel 252 adjacent horizontal panel 26 and flaps 202 and 204. An inward horizontal bend along score line 148 positions rail ridge 262 above flaps 202 and 204. A downward horizontal bend along score line 158 positions rail flap tabs 60 into panel slots 62. This bend secures angles formed by side panel 34 and flap 202 and side panel 36 and flap 204 firmly in contact with rail 38. A notch formed by an outer longitudinal edge 222 and the transverse edge 242 of flap 202 is also firmly secured against the angle formed by horizontal panel 26 and inner vertical panel 50. Flap 204 is similarly secured. An upward horizontal bend along score line 168 serves to position rail flap 54 in contact with horizontal panel 26 and thus assists in transferring stress away from rail 38 towards horizontal panel 26.

For applications where the double material thickness of rail 38 is still insufficient to prevent buckling, rail 38 may be further strengthened by insertion of a stiffener 298 such as an appropriately shaped piece of plywood. Stiffener 298 is placed adjacent outer rail panel 252 between flaps 202 and 204 before the downward vertical bend along line 262 positions inner rail panel 256 parallel with outer rail panel 252. Likewise, stiffener 299 may form part of rail 40.

The problem of fork entry flaps loosening and/or blocking entry slot 32 has been eliminated by either providing a unitary shipping package 420 or by a shipping base, 20 having no flaps transversely oriented with respect to fork entry 32.

The assembly of FIG. 3 has the further advantage that a pair of flaps such as 204 and 206 associated with a vertical side panel 36 may be left unassembled until the rest of shipping base 20 is completed. An item to be shipped may then be inserted into the shipping base 20 and flaps 204 and 206 secured as a final step. This enables the item to be shipped to be slid easily into position if it is particularly heavy or awkward to handle.

Figure 4:
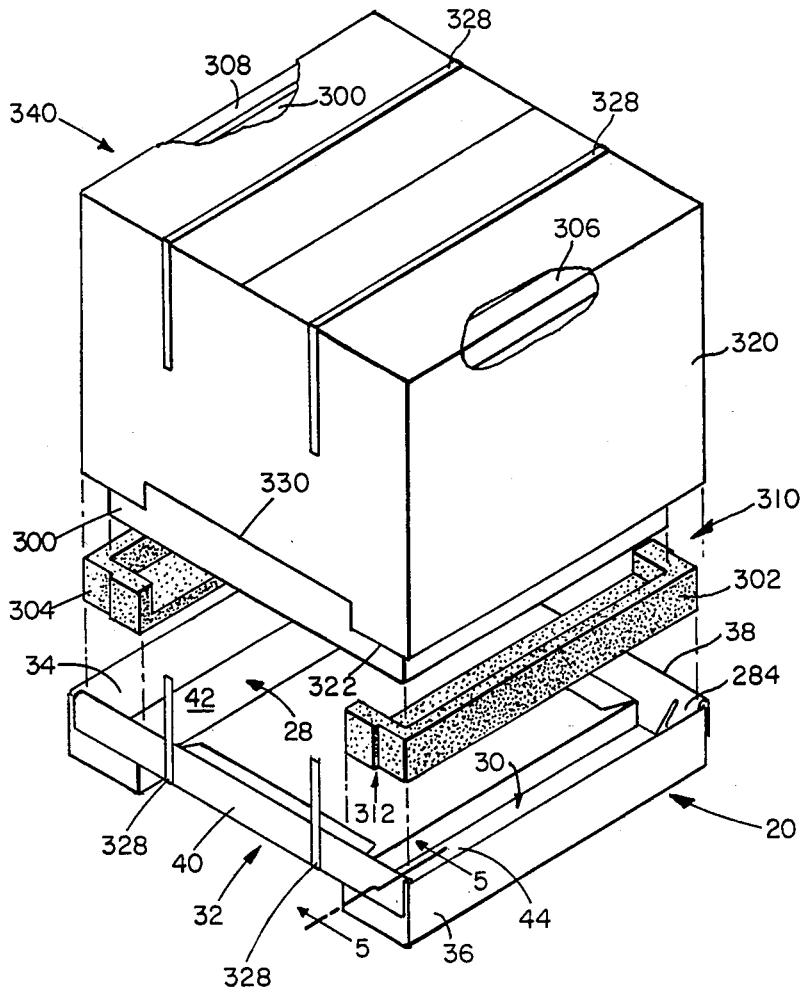
FIG. 4 is an exploded view of the shipping base, associated shipping pads and a cardboard sleeve surrounding an item to be shipped.

FIG. 4 shows how shipping base 20 may be used as part of a shipping package assembly 340 to encapsulate an item to be shipped 300. Shipping pads 302 and 304 are inserted into shipping base 20, after its assembly. Shipping pads 302 and 304, composed of any material commonly used for shipping pads such as, for example, polystyrene or other rigid material, are formed in an appropriate shape for filling upward facing rectangular channels 28 and 30 as well as for encapsulating the lower edges of item 300. Because shipping base 20 is a self-supporting structure, shipping pads 302 and 304 need only contain sufficient material to encapsulate and support item 300 and not the shipping base 20.

The positioning tabs, such as 284, formed as part of the vertical rails, such as 38, are preferably designed to spring inward upon assembly of shipping base 20. Positioning tab 284 is dimensioned to laterally and longitudinally engage an impression 310 formed on an end of shipping pad 302. An impression 312 formed on the opposing end of shipping pad 302 is similarly engaged by a positioning tab 286 (not shown in FIG. 4) formed in front vertical rail 40. After assembling shipping base 20, inserting shipping pad 302 into channel 30 and thereby causing positioning tabs 284 and 286 to engage impressions 310 and 312, shipping pad 304 is likewise inserted into channel 28 and engaged by other positioning tabs 280 and 286 (not shown in FIG. 4). Item 300 is then placed in contact with shipping pads 302 and 304. At this point, the shipping package assembly 340 may be encapsulated with an overwrap shrink film (not shown) or other flexible material capable of being placed under tension and sufficiently strong to secure item 300, pads 302 and 304 and shipping base 20. Two additional conventional shipping pads 306 and 308 may be used to encapsulate the top edges of item 300. A conventional shipping sleeve 320 having an open bottom end 322 may be fit over pads 306 and 308 and item 300 and placed in contact with shipping base 20 adjacent pads 302 and 304. Sleeve 320 may be formed of corrugated fiberboard or similar material sufficient to further contain, protect, or provide additional support for item 300. The outside dimension of sleeve 320 is smaller than the inside dimension of shipping base 20 along rear rail 38, side panel 34, front rail 40 and side panel 36. This places the bottom end 322 of sleeve 320 entirely inside shipping base 20 thereby obtaining the maximum stacking strength available from the shipping assembly 340 while eliminating the telescoping problem associated with prior shipping package assemblies.

Sleeve 320 may be secured to the other components of shipping assembly 340 by straps 328 circumscribing sleeve 320 and base 20. Sleeve 320 may also be designed with a cut-out portion 330 along bottom ends 322 placed adjacent rails 38 and 40, the cut-out 330 conforming to the size and shape of fork entry 32. If such a cut-out 330 is formed, sleeve 320 thus fits into rectangular channels 28 and 30 and contacts foot panels 42 and 44. This in turn transfers the stress of a load placed upon shipping assembly 340 towards foot panels 42 and 44 and ultimately away from foot panels 44 and 42 to the structure below foot panels 42 and 44 or out to rails 38 and 40.

Figure 5:
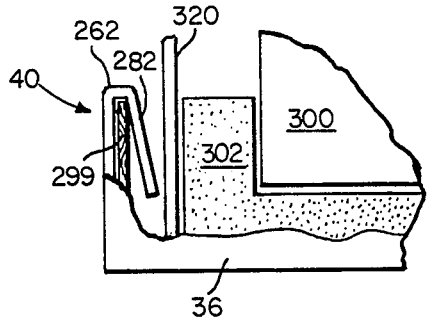
FIG. 5 is a cut-away view of the assembled shipping base, shipping pads, and sleeve showing their respective arrangement and the function of a pad positioning tab.

FIG. 5 is a partial cut-away view of shipping assembly 340 taken in the direction of arrows 5. It shows item 300, shipping pad 302, sleeve 320, a partial view of side panel 36. It also shows front rail 40 and its various components, including positioning tab 282, rail ridge 262 and stiffener 299 and their relative position in fully assembled form.

Figure 6:
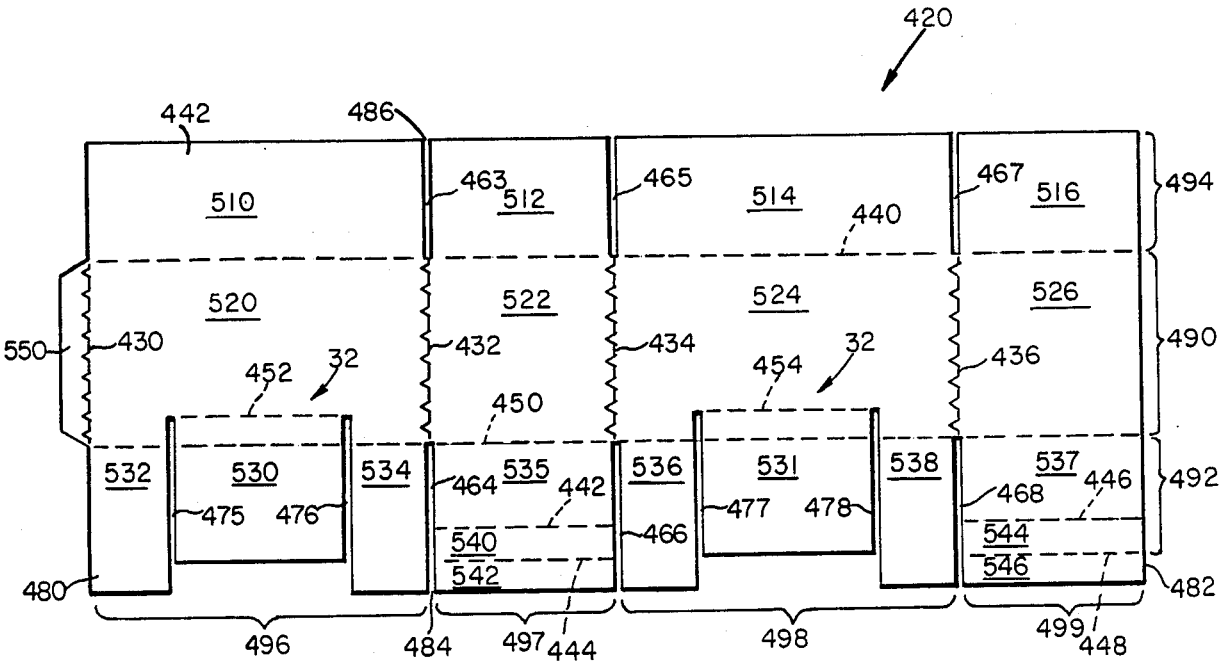
FIG. 6 is a plan view of a material blank from which an alternative embodiment of this invention as a unitary container may be made.
Figure 7:
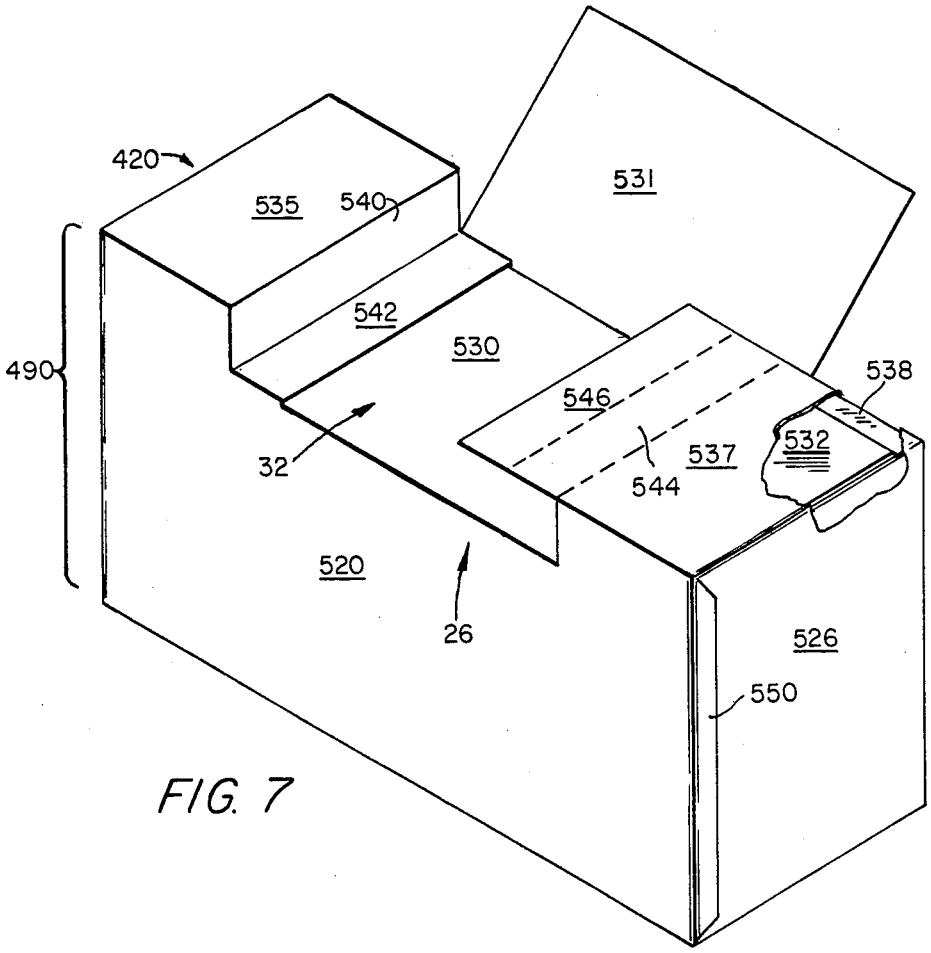
FIG. 7 is a perspective view of such a unitary container.

FIGS. 6 and 7 show an alternative embodiment of this invention as a unitary shipping package 420. Shipping package 420 is formed from a single blank 402 of suitable material such as corrugated fiberboard. As previously described for the embodiment as a shipping base 20 shown in FIG. 2, the unitary shipping package 420 is defined by a series of transverse and longitudinal score lines and appropriately placed slots in the substantially rectangular sheet 442. More particularly, two transverse score lines 440 and 450 extend between opposing edges 480 and 482 of sheet 442 and divide sheet 442 into a main body portion 490, a bottom flap portion 492 and a top flap portion 494. Top flap portion 494 may be eliminated if it is desired to use unitary shipping package 420 together with shipping sleeve 320 or an appropriate shipping cap. However, one important advantage of unitary shipping package 420 is that item 300 may be entirely encapsulated by a package formed from a single sheet 442.

A series of longitudinal score lines 430, 432, 434, and 436 together with longitudinal slots 463 and 464, aligned adjacent and parallel to score line 432, longitudinal slots 465 and 466 aligned adjacent and parallel to score line 434 and longitudingal slots 467 and 468 aligned adjacent and parallel to score line 436, serve to delimit front portion 496, right portion 497, rear portion 498 and left portion 499. Longitudinal score lines 430, 432, 434 and 436 and accompanying longitudinal slots 463, 464, 465, 466, 467 and 468 are appropriately spaced to provide a container of sufficient width and depth to encapsulate item 300. Longitudinal slots 463 and 464 extend, respectively, from points along top edge 486 and bottom edge 484 inward to transverse score lines 440 and 450. Longitudinal slots 465, 466, 467 and 468 similarly extend inward from top edge 486 and bottom edge 484 to score lines 440 and 450. Other longitudinal slots 475 and 476 are disposed between and parallel to slot 464 and edge 480. Similarly, longitudinal slots 477 and 478 are disposed between and parallel to slots 466 and 468. These slots extend inward from a point near bottom edge 484 to a transverse score line 452, the transverse score line 452 being disposed between score lines 450 and 440. The area thus defined by slots 475 and 476 and score lines 450 and 452 determines the width and height of entry slot 32 formed in front panel 496. Longitudinal slots 477 and 478 together with score line 454 disposed between score lines 450 and 440 are also appropriately positioned to provide a portion of entry slot 32 in rear portion 498.

A pair of transverse score lines 442 and 444 extend between slots 464 and 466 in the bottom flap portion 492 of right portion 497. Similarly, score lines 446 and 448 are disposed between slot 468 and edge 482 in the bottom flap portion 492 of left panel 499.

The foregoing series of score lines and slots are used to define the various panels of unitary shipping carton 420. In particular, score line 440, top edge 486, opposing edges 480 and 482 of sheet 442 and slots 463, 465 and 467 define front flap 510, right flap 512, rear flap 514 and left flap 516. Score lines 440, 450, 430, 432, 434, 436, 452 and 454, opposing edges 480 and 482, and slots 475, 476, 477 and 478 define front panel 520, right panel 522, rear panel 524 and left panel 526. Similarly, score lines 450 and 452, slots 475, 476, 464, 466, 477, 478 and 468 and opposing edges 480, 482 and bottom edge 484 define front horizontal panel 530, front left foot flap 532, front right foot flap 534, right side foot panel 535, rear left foot flap 538, rear right foot flap 536, rear horizontal panel 531 and left side foot panel 537. Finally, score lines 442 and 444 and slots 464 and 466 define right vertical foot flap 540 and right horizontal foot flap 542 as part of right side foot panel 535 just as left vertical foot flap 544 and left horizontal foot flap 546 are defined by score lines 446 and 448 as part of left side foot panel 537. Finally, an overlap flap 550 may be formed adjacent front panel 520 at edge 480 if desired.

It may be desirable to eliminate the parts of score line 450 crossing front horizontal panel 530 and rear horizontal panel 531 in order to add to their structural strength. As will be seen shortly, no fold is made along those portions of score line 450.

The assembly of unitary shipping container 420 is partially shown in FIG. 7. Sheet 442 is formed into the three dimensional unitary shipping carton 420 by making vertical bends along score lines 430, 432, 434 and 436 and causing front and rear portions 496 and 498 to become parallel with each other and perpendicular to right and left portions 497 and 499. This also causes the right and left portions 497 and 499 to become parallel with each other. Front portion 496 is then fastened to left protion 499 by glue, staples, using overlap tab 550 (if present) or other conventional means.

Depending upon whether it is desirable to insert item 300 through the top 494 or bottom portion 492 of the unitary shipping package 420, either the bottom portion 492 or top flap portion 494, respectively, is next assembled. In the case shown in FIG. 7, top flap portion 494 was first assembled (not shown) by inward horizontal bends along score line 440 and by then folding front and rear flaps 510 and 514 inwardly. Shipping carton 420 was then turned upside down and bottom flap portion 492 is assembled as follows, after insertion of item 300.

One of the horizontal panels, such as front horizontal 530, is inwardly and horizontally bent along score line 452 to be substantially perpendicular to front panel 520 and right and left panels 522 and 526. Front left foot flap 532 and rear left foot flap 538, now opposing each other, are inwardly folded along score line 450 and thus placed adjacent each other. Left side foot panel 537 is also folded along score line 450 and placed adjacent left foot flaps 532 and 538. Front and rear right foot flaps 534 and 536 as well as right side foot panel 535 are similarly folded and placed adjacent one another. A downward horizontal bend along score line 442 and an outward horizontal bend along score line 444 position right vertical foot flap 540 and right horizontal foot flap 542 adjacent entry slot 32. The substantially right angle thus formed by flaps 540 and 542 adjacent foot panel 535 serve to transfer sheer stress away from foot panel 535 towards horizontal panel 530 and main body portion 490, including both front panel 520 and rear panel 524. Downward and outward horizontal bends along score lines 446 and 448 serve to similarly position left vertical foot flap 544 and left horizontal foot flap 546. This creates a structure serving to transfer stress away from foot panel 537 and foot flaps 538 and 532 onto front horizontal panel 530 and main body portion 490. Finally, rear horizontal panel 531 is folded along score line 454 to place it adjacent flaps 542 and 546 and front horizontal panel 530, thereby forming a double thickness horizontal panel 26.

The triple thickness foot portion including panel 537 and flaps 532 and 538 has been found particularly advantageous when using unitary shipping carton 420 with squeeze clamp type mechanical moving equipment. The various flaps described in this assembly may be glued, stapled or otherwise fastened to each other or to the panel portions for added rigidity. Shrink wrap material or strapping may also be used with unitary shipping carton 420 to further protect and support the package. The unitary construction of shipping carton 420 eliminates the sleeve telescoping problem of prior art shipping containers. Also, the problem of fork entry flaps loosening and/or blocking entry slot 32 has been eliminated by forming adjacent flaps 530 and 531 larger than the height of fork entry 32.

Figure 8:
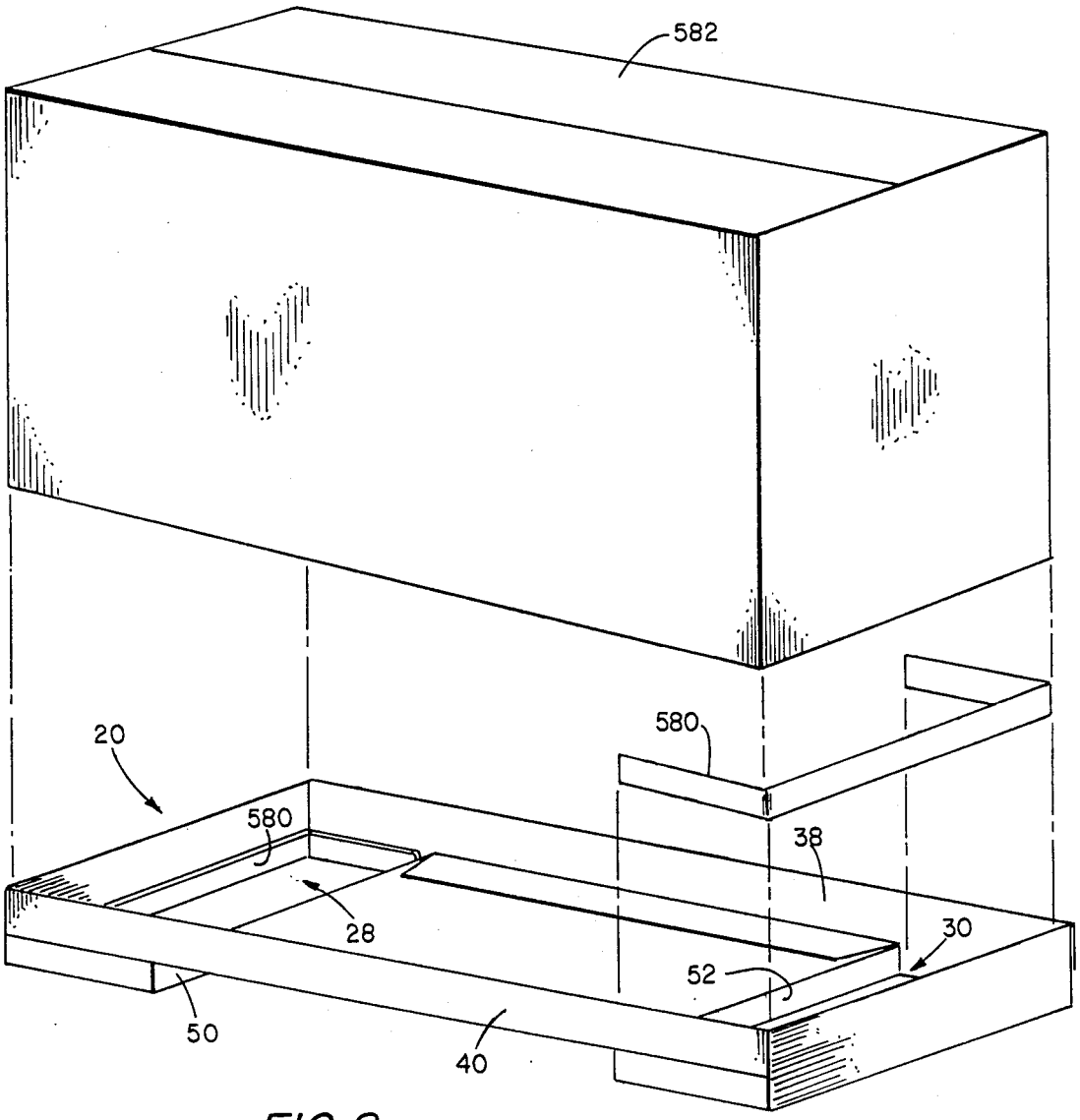
FIG. 8 is a perspective view of the shipping base as may be used with a half-slotted container.
Figure 9:
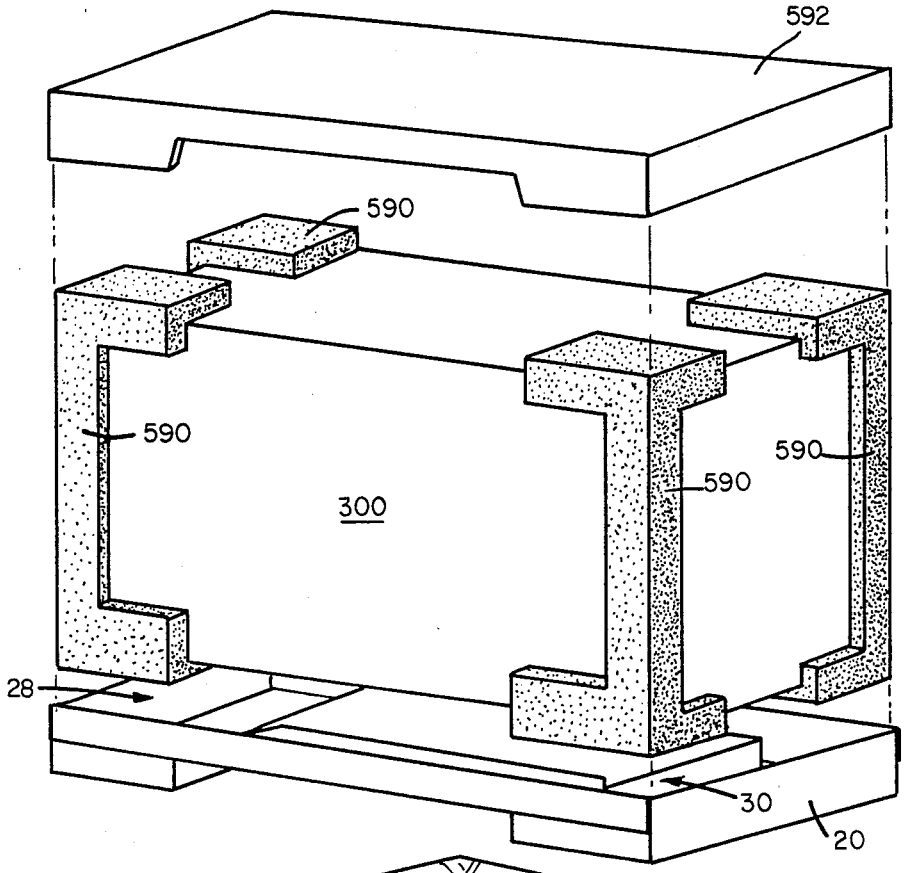
FIG. 9 is a perspective view of the shipping base with corner shipping pads and a rectangular item to be shipped.

Further advantages are obtained through the use of structurally self supporting shipping base 20 and/or unitary shipping carton 420 according to the invention. Because shipping pads are no longer necessary to provide structural support to shipping base 20, they may be eliminated and replaced by dunnage or other filler material. It may also be advantageous to use rigid inserts 580 formed of a suitable material such as corrugated fiberboard or the like, as shown in FIG. 8. Rigid inserts 580 are simply a strip of material having the same width as the height of interior side panels 50 and 52. Rigid inserts 580 are placed in rectangular channels 28 and 30 with their end portions inwardly bent and placed adjacent front and rear rails 40 and 38. In this manner, a shipping container commonly known as a half-slotted container 582 may be placed upon the shipping base 20 inward of rails 38 and 40 and contacting rigid inserts 580. The stress of the load presented by half-slotted container 582 is thus transferred to the rigid inserts 580 through shipping base 20 and ultimately to structures placed below shipping base 20. If used, the shipping pads may now be formed as corner pads 590 as shown in FIG. 9. Corner pads 590 are shaped to fit the corners of item 300 and serve only to protect and encapsulate item 300 and are not needed to provide structural support for shipping base 20. If such corner pads 590 are used, they may be contained at the top by a shipping cap 592 formed from suitable material such as fiberboard. The shipping cap 592 may be used in place of a shipping sleeve such as shipping sleeve 320 of FIG. 4. This package including shipping base 20, corner pads 590, item 300 and shipping cap 592, is then assembled by placing corner pads 590 inside rectangular channels 28 and 30, arranging cap 592 over the corner pads 590 and securing the entire assembly secured by using an overwrap shrink film (not shown), strapping (not shown) or other securing devices.

Figure 10:
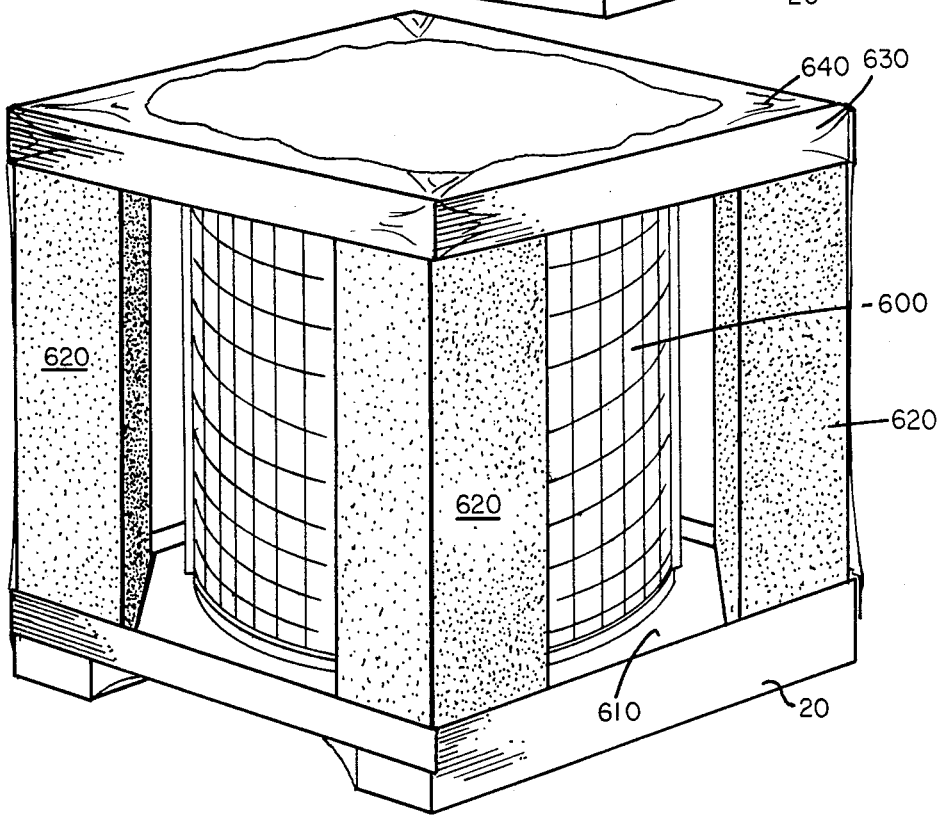
FIG. 10 is a perspective view of the shipping base and corner posts adapted for a cylindrical item to be shipped.

The shipping base 20 embodied as a rectangular shipping base is found to be the strongest and simplest to use. In light of the foregoing disclosure, it is now evident to those of skill in the art that similar shipping bases may be formed in other polygonal shapes, such as octagonal, to accommodate oddly shaped items. However, another advantage of a structurally self-supporting package is that oddly shaped items such as a cylindrical air conditioning unit 600 of FIG. 10 may be more easily accommodated. A shipping pad 610 shaped to accommodate cylindrical item 600 and also having portions adapted to engage rectangular shipping channels 28 and 30 (not shown) may be formed from one or more pieces of material. This in turn may be augmented by shipping posts 620 having a triangular cross-section, the shipping posts 620 also adapted to engage rectangular channels 28 and 30 at their bottom ends. Shipping posts 620, shipping base 20, shipping pad 610 and item 600 are encapsulated by a shipping cap 630 and secured by overwrap shrink film 640 or other means such as straps. In this manner, a non-rectangular item, such as cylindrical item 600, may be stacked just as or together with rectangular items, and moved by mechanical handling equipment.

Figure 11:
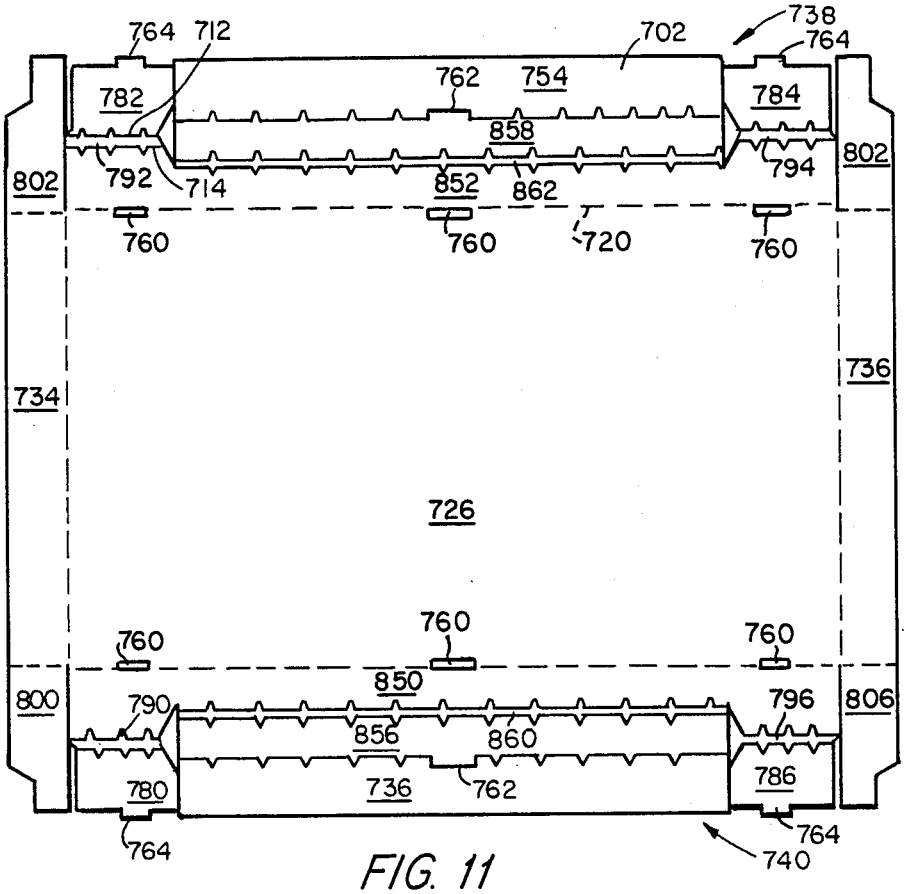
FIG. 11 is a plan view of a material blank from which a shipping cap may be formed according to this invention.

Shipping packages such as shipping base 20 and unitary shipping carton 420 requiring multiple bending and/or fastening operations during their assembly and thus often require the use of special jigs to expedite their assembly. FIG. 11 shows a variation possible to eliminate the need for special assembly jigs. While a shipping cap 700 is shown, it should be understood that a shipping base such as shipping base 20 may also be similarly formed. Just as that previously described for FIG. 2, shipping cap 700 is formed from a single blank of material 702. Central horizontal panel 726, side panels 734 and 736, end flaps 800, 802, 804 and 806, and outer rail panels 850 and 852 are formed from sheet 702 by appropriately placed score lines (not numbered). Similarly defined are rail ridges 860 and 862, inner rail panels 856 and 858, and rail flaps 736 and 754. However, in this instance, rail ridges 860 and 862, inner rail panels 856 and 858 and rail flaps 736 and 754 have shortened ends so that their length is less than the length of corresponding outer rail panels 850 and 852. This allows formation of end flap ridges 790 and 796 adjacent outer rail panel 850 and end flap ridges 792 and 794 adjacent outer rail panel 852, as well as formation of end flap retainers 780, 782, 784 and 786 adjacent end flap ridges 790, 792, 794 and 796, respectively.

Figure 12:
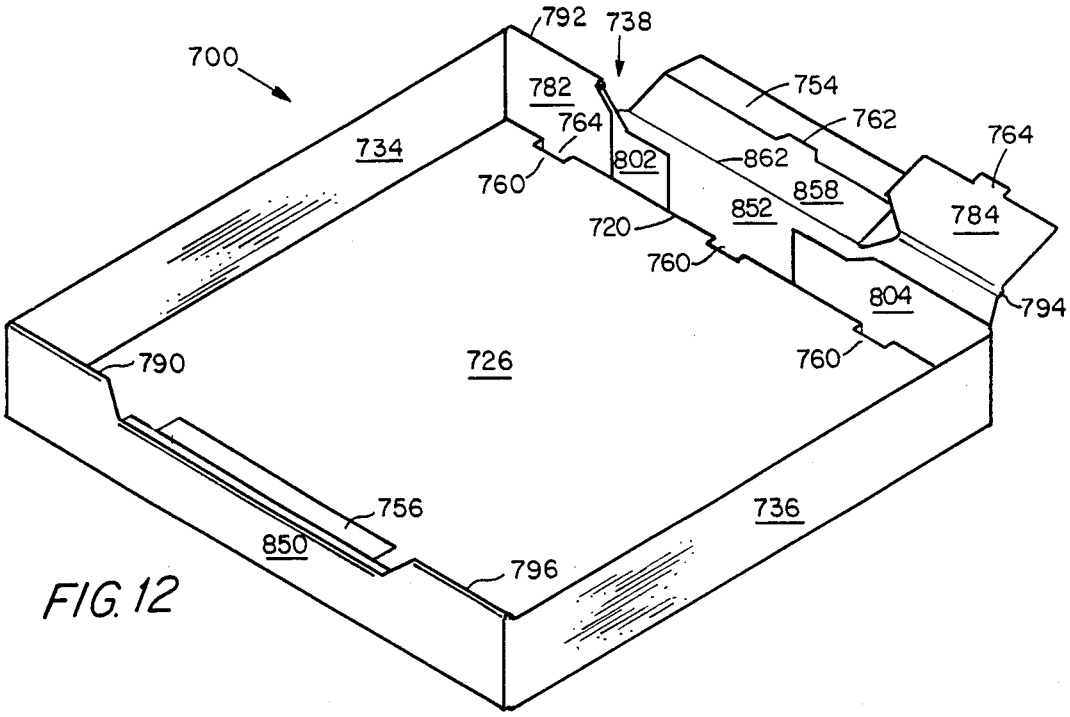
FIG. 12 is a perspective view of a partially assembled shipping cap.

The assembly of shipping cap 700 proceeds, as shown in FIG. 12, by upward horizontal bends placing side panels 734 and 736 substantially perpendicular to horizontal panel 726. End flaps 802 and 804, by a vertical inward bend, are placed adjacent a rear edge 720 of central horizontal panel 726. End flap ridge 792 is then placed adjacent and over end flap 802 by an inward horizontal bend along score line 712 and a downward horizontal bend along outer score line 714. An end flap retainer tab 764 formed as part of end flap retainer 782 is then caused to engage horizontal panel slot 760 formed in central horizontal panel 726, thereby placing end flap retainer 782 adjacent and parallel with end flap 802 and outer rail panel 852. End flap 804 is similarly brought adjacent to outer rail panel 852 and secured by folding end flap ridge 794 and end flap retainer 784.

Thus, by first assembling the end flap retainers 782 and 784, end flaps 802 and 804 are caused to form rigid right angles with side panel 734 and 736, respectively. This frees the assembler's hands for completing assembly of rear vertical rail 738. This is accomplished by bringing rail ridge 862, inner rail panel 858 and rail flap 754 into position by suitable horizontal inward and downward bends and insertion of one or more rail tabs 762 into an appropriately positioned horizontal panel slots 760. The stiffener (not shown) may now more easily be placed adjacent rail panel 852 before assembly of rear rail 738.

Those of skill in the art will recognize that the above possible applications of shipping base 20, unitary shipping carton 420 and/or cap 700 are illustrative only, and not meant to be limiting in any way. For example, rather than forming flap portions, such as 200, 202, 204 and 206 of FIG. 2, adjacent sides 34 and 36, such side portions 34 and 36 may be formed as the rail portions 38 and 40 were formed from multiple bends and tabs and slots, and the flaps thusly formed adjacent front and rear rails 40 and 38 instead. It may also be preferable for the various slots described above in the various embodiments to be disposed and partially diagonal or offset position with respect to the various score lines in order to provide added rigidity to shipping base 20. Likewise, upward facing rectangular channels 28 and 30 might be positioned in other orientations and/or configurations such as disposing three of such channels so that mechanical handling equipment such as a forklift might be inserted on either side of a center rectangular channel. Thus, it is intended that this invention cover all forms of implementation including modifications, alterations, and changes falling within the true spirit and scope of the appended claims.

What is claimed is:

1. A shipping package comprising:

a horizontal panel having a first pair of opposing parallel edges and a second pair of opposing parallel edges;

a pair of rectangular upwardly facing channels, each one of said channels disposed adjacent a corresponding one of the first pair of edges;

a pair of rails, each one of said rails disposed adjacent a corresponding one of the second pair of edges;

means disposed between at least one of said channels and at least one of said rails for transferring shear stress;

said at least one of said rails comprising an outer panel disposed adjacent and integrally connected to the corresponding one of the second pair of edges and an inner panel disposed near the corresponding one of the second pair of edges and parallel to and spaced apart from said outer panel, said inner panel being disposed close to a central portion of said horizontal panel than said outer panel; and said inner panel having a pair of positioning tabs on opposing ends, said positioning tabs respectively extending into said pair of channels.

2. The shipping package as in claim 1 where the pair of positioning tabs spring inwardly away from said outer panel and are adapted to engage opposing ends of a shipping pad when the shipping pad is disposed within one of the rectangular upwardly facing channels.

3. A shipping package formed from a unitary sheet of material, for supporting and protecting an item to be shipped, and for elevating the item to provide an entry slot for use by mechanical material handling equipment, comprising:

a horizontally oriented rectangular panel having a first pair of opposing parallel horizontal edges and a second pair of opposing parallel horizontal edges, the first pair of opposing edges disposed perpendicular to the second pair of opposing edges;

a pair of rectangular vertical channels, disposed along and integrally connected to the first pair of opposing parallel edges, said entry slot being defined by a space below said horizontal panel and between said channels, each one of said channels including an interior vertical panel, a horizontal foot panel, and a vertical slow panel, the vertical side panel being greater in height than the interior panel, the interior panel integrally connected to a corresponding one of the first pair of edges and the foot panel, and the side panel also integrally connected to the foot panel;

a pair of vertical rails, disposed along and integrally connected to the second pair of opposing parallel edges, each one of said rails including a vertical outer panel, a horizontal ridge panel, and a vertical inner panel, the outer panel integrally connected to a corresponding one of the second pair of edges and the ridge panel, the inner panel spaced apart from the outer panel and integrally connected to the ridge panel, and the outer and inner panels defining a rail flap slot at ends of the vertical rails; and four side panel flaps, each flap disposed along and integrally connected to a corresponding end of one of the vertical side panels formed in said pair of channels, each flap juxtaposed so as to engage a corresponding one of the rail flap slots formed in said pair of rails.

4. The shipping package as recited in claim 3 wherein said horizontally oriented rectangular panel has a plurality of slots adjacent said second pair of edges and said inner panels have a like plurality of tabs correspondingly disposed along the respective bottom edges for inserting into said slots.

5. The shipping package as recited in claim 3 additionally comprising a structural support member disposed parallel to and between said outer and inner panels.

6. The shipping package as recited in claim 3 additionally comprising a pair of positioning tabs on opposing ends of said inner panel for inserting in said channels.

7. The shipping package as recited in claim 3 wherein said flaps have a notch disposed on the end thereof for engaging said horizontally oriented rectangular panel.

8. The shipping package as recited in claim 3 additionally comprising a rail flap disposed along, integrally connected to said vertical inner panel, and positioned it contact with said horizontal panel.

9. A method of packaging an item to be shipped comprising the steps of:

providing a horizontal panel having a first pair of opposing parallel edges and a second pair of opposing parallel edges;

providing a pair of rectangular upwardly facing channels, each one of the channels disposed adjacent a corresponding one of the first pair of edges;

providing a pair of rails, each one of said rails disposed adjacent a corresponding one of the second pair of edges;

said rails comprising an outer panel disposed adjacent and integrally connected to the corresponding one of the second pair of edges and an inner panel, disposed near the corresponding one of the second pair of edges and parallel to and spaced apart from the outer panel, the inner panel disposed closer to a central portion of the horizontal panel than the outer panel;

providing means disposed between at least one of the channels and at least one of the rails for transferring shear stress;

providing a pair of positioning tabs formed near opposing edges of the inner panel; and providing a shipping pad adapted to be disposed within one of the upwardly facing channels and also adapted to engage the pair of positioning tabs.

* * * * *

UNITED STATES PATENT AND TRADEMARK OFFICE

CERTIFICATE OF CORRECTION

PATENT NO. : 4,717,025

DATED : January 5, 1988

INVENTOR(S) : Donald J. Maurer

It is certified that error appears in the above-identified patent and that said Letters Patent is hereby corrected as shown below:

On Cover Sheet, please change the Assignee from "Raytheon Company, Lexington, Mass." to --Amana Refrigeration, Inc., Amana, Iowa--.

Signed and Sealed this

Thirteenth Day of September, 1988

*Attest:*

DONALD J. QUIGG

*Attesting Officer*

*Commissioner of Patents and Trademarks*